US006482534B2

(12) United States Patent
Itsukaichi et al.

(10) Patent No.: US 6,482,534 B2
(45) Date of Patent: Nov. 19, 2002

(54) SPRAY POWDER, THERMAL SPRAYING PROCESS USING IT, AND SPRAYED COATING

(75) Inventors: Tsuyoshi Itsukaichi, Aichi (JP); Satoru Osawa, Aichi (JP)

(73) Assignee: Fujimi Incorporated, Nishikasugai-gun (JP)

( * ) Notice: Subject to any disclaimer, the term of this patent is extended or adjusted under 35 U.S.C. 154(b) by 2 days.

(21) Appl. No.: 09/781,285

(22) Filed: Feb. 13, 2001

(65) Prior Publication Data

US 2001/0019742 A1 Sep. 6, 2001

(30) Foreign Application Priority Data

Feb. 17, 2000 (JP) ..... 2000-038969

(51) Int. Cl.[7] ..... B32B 5/16
(52) U.S. Cl. ..... 428/569; 428/667; 428/402
(58) Field of Search ..... 428/569, 667, 428/402

(56) References Cited

U.S. PATENT DOCUMENTS

| | | | | |
|---|---|---|---|---|
| 4,865,252 A | * | 9/1989 | Rotolico et al. | 239/8 |
| 5,075,129 A | * | 12/1991 | Jackson et al. | 427/34 |
| 5,419,976 A | * | 5/1995 | Dulin | 428/570 |
| 5,580,833 A | * | 12/1996 | Fu et al. | 501/87 |
| 5,747,163 A | * | 5/1998 | Douglas | 428/404 |
| 5,789,077 A | * | 8/1998 | Nakahama et al. | 428/336 |
| 5,928,976 A | * | 7/1999 | Yamamoto et al. | 501/87 |
| 6,254,704 B1 | * | 7/2001 | Laul et al. | 148/513 |

FOREIGN PATENT DOCUMENTS

| | | |
|---|---|---|
| CN | 1203960 | 1/1999 |
| DE | 197 11 642 | 9/1998 |
| EP | 0 425 464 | 5/1991 |
| EP | 0 788 993 | 8/1997 |
| GB | 874463 | 8/1961 |
| GB | 1 385 479 | 2/1975 |
| JP | 60-089557 | 5/1985 |
| JP | 10-110252 | 4/1998 |

OTHER PUBLICATIONS

Kazumi Tani, Chemical Abstracts, vol. 130, No. 24, AN 327721f, Jun. 14, 1999, "Characteristic Evaluation and Application Study of WC CERMET Sprayed Film Obtained By High—Speed Gas Flame Spray Method", 1998 (English Abstract only).

* cited by examiner

*Primary Examiner*—Hoa T. Le
(74) *Attorney, Agent, or Firm*—Oblon, Spivak, McClelland, Maier & Neustadt, P.C.

(57) ABSTRACT

A spray powder which has a particle size of from 6 to 63 $\mu$m and which comprises from 75 to 95 wt % of a ceramic phase made of a WC powder and at least one chromium carbide powder selected from the group consisting of $Cr_3C_2$, $Cr_7C_3$ and $Cr_{23}C_6$, and from 5 to 25 wt % of a metal phase made of a Ni or Ni-based alloy powder, wherein the mean particle size of primary particles of the WC powder constituting the ceramic phase is from 5 to 20 $\mu$m, and the mean particle size of primary particles of the chromium carbide powder is from 1 to 10 $\mu$m.

6 Claims, 1 Drawing Sheet

SPRAY POWDER, THERMAL SPRAYING PROCESS USING IT, AND SPRAYED COATING

The present invention relates to a spray powder, a thermal spraying process using it and a sprayed coating. More particularly, the present invention relates to a spray powder which is capable of showing high deposition efficiency and which is capable of forming a sprayed coating having extremely high toughness and impact resistance as compared with conventional products and also having excellent corrosion resistance and wear resistance in a wet environment, and a thermal spraying process employing it and a sprayed coating.

Metal parts of various industrial machines or general-purpose machines are required to have various properties such as corrosion resistance, wear resistance and heat resistance depending upon the respective purposes. However, in many cases, the metals can not adequately satisfy the required properties by themselves, and it is often attempted to solve such problems by surface modification. A thermal spraying process is one of surface modification techniques which are practically used, as well as physical vapor deposition or chemical vapor deposition. Thermal spraying has characteristics such that the size of a substrate is not limited, a uniform sprayed coating can be formed on a substrate having a large surface area, the speed of forming the coating is high, its application on site is easy, and a thick coating can be formed relatively easily. In recent years, its application has been expanded to various industries, and it has become an extremely important surface modification technique.

With respect to a thermal spraying process, various techniques have been developed. Among them, high velocity flame spraying has characteristics such that the particle velocity is high, and the particles will impinge on a substrate at a high speed, whereby a highly dense coating having a high adhesion to the substrate can be obtained, inclusion of atmospheric air into the flame is relatively small, and yet the particle velocity is large, whereby the dwelling time in the flame is short, overheating of particles is less, and modification of the spray material is little.

As a spray material, WC has extremely high hardness and is excellent in wear resistance. However, spraying of WC alone is difficult. Usually, WC is used as mixed or complexed with a metal such as Co or Ni, or an alloy containing such a metal, as a binder. A sprayed coating formed from a WC/chromium carbide/Ni or Ni-based alloy spray powder using a Ni or Ni-based alloy as a binder, shows excellent corrosion resistance and wear resistance in a wet environment and thus is being widely employed.

However, a sprayed coating formed by using the above spray powder has a problem that it is poor in toughness and impact resistance. Specifically, such a spray powder is often sprayed to parts which will be used in a wet environment, and if the sprayed coating receives a substantial impact during its use, the coating will have cracks, which tend to cause peeling of the coating from the substrate. If this happens, the useful life of the product will be short, and the application of the sprayed coating will be limited.

The present inventors have conducted extensive researches to solve the above problems and as a result, have found that it is possible to obtain a spray powder which shows high deposition efficiency and which is capable of forming a sprayed coating having extremely high toughness and impact resistance and also having excellent corrosion resistance and wear resistance in a wet environment, by agglomeration and sintering of material powders (WC, a chromium carbide and a Ni or Ni-based alloy) having their particle sizes adjusted within proper ranges. The present invention has been accomplished on the basis of this discovery.

That is, in order to solve the above problems, the present invention provides a spray powder which has a particle size of from 6 to 63 $\mu$m and which comprises from 75 to 95 wt % of a ceramic phase made of a WC powder and at least one chromium carbide powder selected from the group consisting of $Cr_3C_2$, $Cr_7C_3$ and $Cr_{23}C_6$, and from 5 to 25 wt % of a metal phase made of a Ni or Ni-based alloy powder, wherein the mean particle size of primary particles of the WC powder constituting the ceramic phase is from 5 to 20 $\mu$m. and the mean particle size of primary particles of the chromium carbide powder is from 1 to 10 $\mu$m.

Further, the present invention provides a thermal spraying process which comprises carrying out high velocity flame spraying using such a spray powder, and a sprayed coating which is formed by carrying out high velocity flame spraying using such a spray powder and which comprises from 75 to 95 wt % of a ceramic phase made of the WC powder and the chromium carbide powder, and from 5 to 25 wt % of a metal phase made of the Ni or Ni-based alloy powder, wherein the mean particle size of primary particles of the WC powder constituting the ceramic phase is from 5 to 20 $\mu$m. and the mean particle size of primary particles of the chromium carbide powder is from 1 to 10 $\mu$m.

Figure 1:
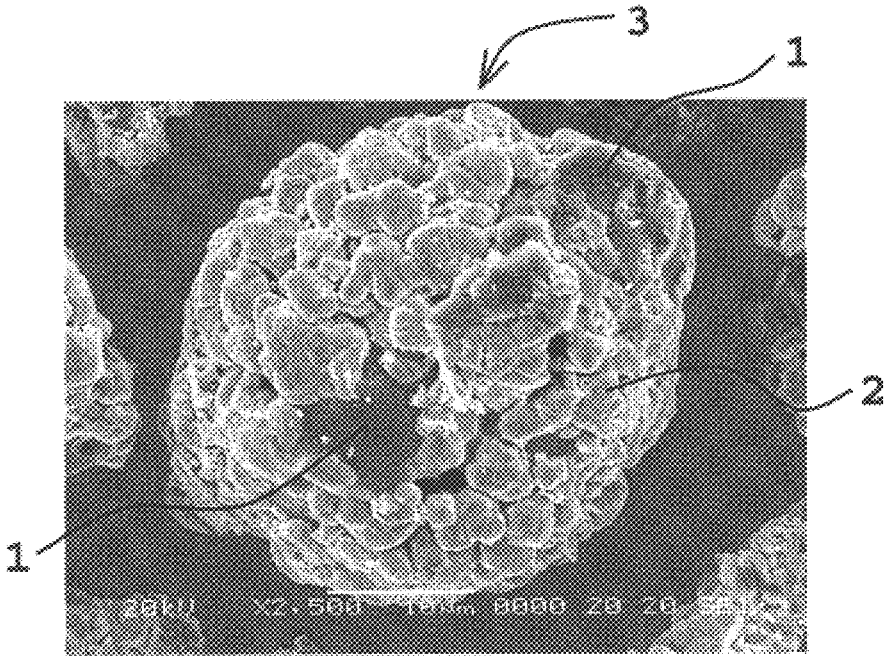
FIG. 1 is a copy of a microscopic photograph of the spray powder prepared in Example 1 of the present invention (magnifications: ×2,500).

In the Figures, reference numeral 1 indicates the primary particles of WC, numeral 2 the primary particles of chromium carbide, numeral 3 the spray powder, numeral 10 the primary particles of WC, numeral 20 the primary particles of chromium carbide, and numeral 30 the spray powder.

Now, the present invention will be described in detail with reference to the preferred embodiments.

The mean particle size of the WC powder to be used in the present invention is from 5 to 20 $\mu$m, preferably from 10 to 15 $\mu$m. The mean particle size of the chromium carbide powder to be used in the present invention is from 1 to 10 $\mu$m, preferably from 3 to 6 $\mu$m. Further, the mean particle size of the Ni or Ni-based alloy powder to be used in the present invention is usually within a range of from 1 to 15 $\mu$m, preferably from 1 to 10 $\mu$m. If the mean particle sizes of the WC powder and the chromium carbide powder are less than 5 $\mu$m and less than 1 $\mu$m, respectively, the sprayed coating is likely to have cracks by impact, and the toughness and impact resistance tend to be low. Further, if the mean particle sizes of the WC powder and the chromium carbide powder exceed 20 $\mu$m and 10 $\mu$m, respectively, it tends to be difficult to obtain agglomerated powder particles having a particle size of at most 63 $\mu$m, wherein primary particles are uniformly distributed, by agglomeration, and the deposition efficiency tends to be very low.

The Ni or Ni-based alloy powder to be used in the present invention will be melted or semi-melted when heated by the flame for thermal spraying. The smaller the particle size, the easier the melting or semi-melting However, to obtain a Ni or Ni-based alloy powder having a mean particle size of less than 1 $\mu$m. the production costs tend to be very high, such being undesirable. If the mean particle size of the Ni or Ni-based alloy powder exceeds 15 $\mu$m, it tends to be difficult to obtain agglomerated powder particles having a mean particle size of at most 63 μm wherein primary particles are uniformly distributed, by agglomeration, and it tends to be difficult to melt or semi-melt the Ni or Ni-based alloy particles during the thermal spraying.

In the present invention, from 60 to 80 wt % of the WC powder having a mean particle size of from 5 to 20 μm, from 10 to 20 wt % of the chromium carbide powder having a mean particle size of from 1 to 10 μm, and from 5 to 25 wt % of the Ni or Ni-based alloy powder having a mean particle size of from 1 to 15 μm, are agglomerated to obtain a composite, followed by sintering. If the ceramic powder comprising WC and the chromium carbide is less than 75 wt % in total, and the Ni or Ni-based alloy powder exceeds 25 wt %, the hardness and wear resistance of a coating formed by the thermal spraying tend to be remarkably low, and such may not be practically useful.

If the ceramic powder comprising the WC powder and the chromium carbide exceeds 95 wt % in total, and the Ni or Ni-based alloy powder is less than 5 wt %, the amount of the Ni or Ni-based alloy serving as a binder for ceramic particles tends to be inadequate, whereby the toughness of the coating formed by the thermal spraying tends to be low, and the adhesion to the substrate tends to be low, thus leading to peeling.

The spray powder of the present invention is preferably one agglomerated into a spherical shape and sintered. The method for agglomerating the spray powder of the present invention into a spherical shape and sintering it, is not particularly limited. For example, the material powders may be mixed, and an organic binder (for example PVA: polyvinyl alcohol) and water (or a solvent such as an alcohol) may be added to obtain a slurry, which may be agglomerated by means of a spray drier to obtain spherical agglomerated powder particles. Further, such agglomerated powder particles may be sintered, crushed and classified to obtain a spherical spray powder of a WC/chromium carbide/Ni or Ni-based alloy composite.

The particle size distribution of the agglomerated powder particles formed in the spray drier is preferably from 5 to 75 μm. By sintering the agglomerated powder particles having a particle size distribution of from 5 to 75 μm, followed by crushing and classification, it is possible to obtain a spray powder having a particle size of from 6 to 63 μm, which is suitable for high velocity flame spraying. The powder spherically agglomerated by the spray drier is subjected to de-waxing at a temperature of from 300 to 500° C., followed by sintering at a temperature of from 1,200 to 1,400° C. in vacuum or in an argon gas atmosphere. By carrying out the sintering in vacuum or in an argon gas atmosphere, an oxidation problem can be eliminated. After the sintering, the solidified WC/chromium carbide/Ni or Ni-based alloy composite is subjected to crushing. The crushing method is not particularly limited, and a conventional crusher may be employed for the crushing.

By the crushing, spherical agglomerated powder particles will be obtained whereby the agglomerated powder particles are independently separated. The crushed spray powder of the WC/chromium carbide/Ni or Ni-based alloy composite, may be classified, as the case requires. For example, the spray powder may be classified into a particle size distribution of from 6 to 38 μm, from 10 to 45 μm, from 15 to 45 μm, from 15 to 53 μm and from 20 to 63 μm. so that it may be selected for use depending upon the type or the output power of a high velocity flame spraying apparatus. For example, in the case of a diamond jet (standard type) which is a high velocity flame spraying apparatus manufactured by Sulzer Metco, it is preferred to use a spray powder of the WC/chromium carbide/Ni or Ni-based alloy composite having a particle size distribution of from 6 to 38 μm or from 10 to 45 μm.

In the case of a hybrid type diamond jet, a particle size distribution of from 15 to 45 μm or from 15 to 53 μm, is preferred. Further, in the case of JP-5000 which is a high velocity flame spraying apparatus manufactured by TAFA Company, it is preferred to employ a spray powder having a particle size distribution of from 15 to 45 μm with a composition comprising 70 wt % of the WC powder, 15 wt % of the chromium carbide powder and 15 wt % of the Ni or Ni-based alloy, whereby the Vickers hardness of the sprayed coating will be as high as from 1,100 to 1,300 $kg/mm^2$, and the coating will show good wear resistance and impact resistance. By carrying out high velocity flame spraying using the spray powder of the WC/chromium carbide/Ni or Ni-based alloy composite, it is possible to obtain a dense sprayed coating, wherein pores in the sprayed coating are as little as not more than 3%.

Now, the present invention will be described in further detail with reference to Examples. However, it should be understood that the present invention is by no means restricted by such specific Examples. In the Example and Comparative Examples, the properties of the spray powder and the sprayed coating were measured by the following methods.

(1) Deposition Efficiency

The weight increase of the substrate by thermal spraying was measured, and the deposition efficiency was obtained as its ratio to the weight of the spray powder used. A cleaned and surface-roughened carbon steel sheet of 7.5 cm×25 cm was used as the substrate, and as the thermal spray equipment, JP-5000, manufactured by TAFA Company was used. The thermal spraying conditions were as follows.

Oxygen flow rate: 1,900 scfh

Kerosene flow rate: 5.5 gph

Powder flow rate: 100 g/min

Spray distance: 380 mm (2) Vickers Hardness

The sprayed coating (thickness of the sprayed coating: 300 μm) formed by the above thermal spraying test was cut, and the cross section was mirror-polished, whereupon the Vickers hardness of the cross section of the sprayed coating was measured. As the testing machine, Vickers hardness tester HMV-1, manufactured by Shimadzu Corporation was used. The indentater was a diamond pyramid indenter with an angle between the opposite faces being 136°. The test load of the indentater was 0.2 kgf, and the holding time after the loading was 15 seconds.

(3) Evaluation of Toughness

Using a Vickers hardness tester HMV-1 manufactured by Shimadzu Corporation, the load of the indentater was adjusted to be 1 kgf, and after the loading, the holding time was 30 seconds, whereby the toughness of the sprayed coating was evaluated on the basis of whether or not cracks were formed around the indentation. The measured sprayed coating was the same as one used in (2). The indentater was a diamond pyramid indenter with an angle of the opposite faces being 136°. Cracks are likely to form with a sprayed coating having low toughness, and no substantial cracks will be formed with a sprayed coating having high toughness. The measurement was carried out at ten positions, and the toughness was evaluated as follows by the number of times where cracks were observed.

◎: No cracks observed.

○: Cracks observed from 1 to 3 times.

Δ: Cracks observed from 4 to 7 times.

X: Cracks observed at least 8 times.

(4) Evaluation of Wet Wear Resistance

The evaluation was carried out by using a wet abrader as disclosed in JP-A-10-360766. As the abrasive, A#8 (JIS R6111) was used, and water was added thereto to adjust the slurry concentration to 80 wt %. As the standard sample, a carbon steel tube STMK12C for mechanical structure was used. The thickness of the sprayed coating was 300 μm. As the evaluation method, the ratio of the volume wear rate ($mm^3$) of the sample to he volume wear rate ($mm^3$) of the standard sample was calculated as a wear ratio. The test time was 200 hr (sliding distance: $5.67\times10^5$ m). However, with one having cracks or peeling observed during the test time, the wear rate became extremely large. Accordingly, the wear ratio was calculated by the wear rate before the cracks or peeling was observed. A sample having cracks or peeling observed is considered to be poor in toughness and impact resistance.

EXAMPLE 1

PVA and water were added to a mixture comprising 70 wt % of a WC powder having a mean particle size of 11 μm, 15 wt % of a chromium carbide powder having a mean particle size of 5 μm and 15 wt % of a Ni.Cr alloy powder having a mean particle size of 5 μm, followed by stirring to obtain a slurry. The slurry was spray-dried to form spherical agglomerated powder particles, which were sintered at 1,330° C. in an argon gas atmosphere. Then, they were crushed and classified to obtain a spray powder of a WC/chromium carbide/Ni.Cr alloy composite having a particle size distribution of from 15 to 45 μm. FIG. 1 shows an electron microscopic photograph thereof (magnifications: ×2,500). Reference numeral 1 indicates primary particles of the chromium carbide powder, numeral 2 indicates primary particles of the WC powder, and they were combined to form the spray powder having a particle size distribution of from 15 to 45 μm.

Using JP-5000, manufactured by TAFA Company as a high velocity flame spraying equipment, the above spray powder was thermally sprayed using a de-waxed and surface-roughened carbon steel sheet of 7.5 cm×25 cm as a substrate, to form a sprayed coating. The deposition efficiency was 42%, and the Vickers hardness of the sprayed coating was 1,200. In the toughness test, no cracks were observed, and the evaluation was ⊙. In the wet wear test, no cracks or peeling was observed, and the wear ratio was 0.066.

Comparative Example 1

Figure 2:
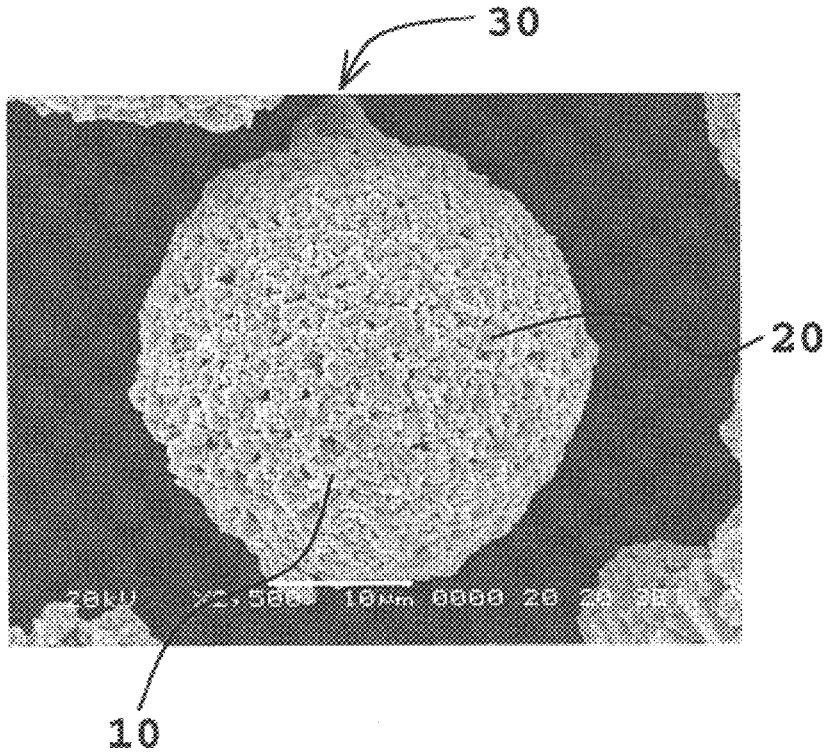
FIG. 2 is a copy of a microscopic photograph of a conventional spray powder (Comparative Example 1) (magnifications: ×2,500).

PVA and water were added to a mixture comprising 70 wt % of a WC powder having a mean particle size of 2 μm, 15 wt % of a chromium carbide powder having a mean particle size of 0.8 μm and 15 wt % of a Ni.Cr alloy powder having a mean particle size of 5 μm, to obtain a slurry. The slurry was spray-dried to form spherical agglomerated powder particles, which were sintered at 1,330° C. in an argon gas atmosphere. Then, they were crushed and classified to obtain a spray powder of a WC/chromium carbide/Ni.Cr alloy composite having a particle size distribution of from 15 to 45 μm. FIG. 2 shows a microscopic photograph thereof (magnifications: ×2,500). Reference numeral 10 indicates primary particles of the chromium carbide powder, and numeral 20 indicates primary particles of the WC powder, and they were combined to form the spray powder having a particle size distribution of from 15 to 45 μm.

Using JP-5000, manufactured by TAFA Company as a high velocity flame spraying equipment, the above spray powder was thermally sprayed using a de-waxed and surface-roughened carbon steel sheet of 7.5 cm×25 cm as a substrate, to form a sprayed coating. The deposition efficiency was 46%, and the Vickers hardness of the sprayed coating was 1,250. However, in the toughness test, cracks were observed nine times, and the evaluation was X, thus indicating that the toughness was very low. In the wet wear test, peeling was observed upon expiration of 90 hours and the wear ratio before the peeling was 0.098.

Comparative Example 2

PVA and water were added to a mixture comprising 70 wt % of a WC powder having a mean particle size of 22 μm, 15 wt % of a chromium carbide powder having a mean particle size of 10 μm and 15 wt % of a Ni.Cr alloy powder having a mean particle size of 5 μm, followed by stirring to obtain a slurry. The slurry was spray-dried to form spherical agglomerated powder particles, which were sintered at 1,330° C. in an argon gas atmosphere. Then, they were crushed and classified to obtain a spray powder of a WC/chromium carbide/Ni.Cr alloy composite having a particle size distribution of from 15 to 45 μm. Using JP-5000, manufactured by TAFA Company as a high velocity flame spraying equipment, the above spray powder was thermally sprayed using a de-waxed and surface-roughened carbon steel sheet of 7.5 cm×25 cm as a substrate, to form a sprayed coating. The deposition efficiency was 30%, and the Vickers hardness of the sprayed coating was 900. In the toughness test, cracks were observed at three positions, and the evaluation was ○. The wear ratio was 0.152. The results of Example 1 and Comparative Examples 1 and 2 are shown in Table 1.

TABLE 1

| | Example 1 | Comparative Example 1 | Comparative Exampel 2 |
|---|---|---|---|
| Mean particle size of WC powder (μm) | 11 | 2 | 22 |
| Mean particle size of chromium carbide powder (μm) | 5 | 0.8 | 10 |
| Mean particle size of Ni.Cr alloy powder (μm) | 5 | 5 | 5 |
| Deposition efficiency (wt %) | 42 | 46 | 30 |
| Vickers hardness | 1,200 | 1,250 | 900 |
| Toughness | ⊙ | X | ○ |
| Wear ratio | 0.066 | 0.098 | 0.152 |
| Cracks or peeling by wet wear test | Nil | Peeling observed (90 hr) | Nil |

The spray powder of the present invention in Example 1 has a high deposition efficiency and provides a sprayed coating which has a Vickers hardness of as high as more than 1,100 and which also has high toughness and wet wear resistance. Whereas, with the spray powder of Comparative Example 1 employing a ceramic powder having a small mean particle size, the deposition efficiency is relatively high, and the Vickers hardness is high, but the toughness and the impact resistance are remarkably low. Also in the wet wear test, the toughness was so low that cracks formed in the sprayed coating, and peeling of the sprayed coating from the substrate resulted. Further, with the spray powder of Comparative Example 2 using a ceramic powder having a large mean particle size, the toughness is poor as compared with Example 1, the deposition efficiency is very low, and the Vickers hardness is also low. Further, the wear ratio is large, and the wet wear resistance of the sprayed coating is very low.

The present invention provides 1) a spray powder of a WC/chromium carbide/Ni or Ni-based alloy composite which has a particle size of from 6 to 63 μm and which comprises from 75 to 95 wt % of a ceramic phase made of a WC powder and a chromium carbide powder and from 5 to 25 wt % of a metal phase made of a Ni or Ni-based alloy powder, wherein the mean particle size of primary particles of the WC powder constituting the ceramic phase is from 5 to 20 μm, and the mean particle size primary articles of the chromium carbide powder is from 1 to 10 μm, and such a spray powder provides a high deposition efficiency in thermal spraying, whereby it is possible to form a sprayed coating having extremely high toughness and impact resistance.

Further, 2) by high velocity flame spraying using the above spray powder, a constant high deposition efficiency can be assured.

Furthermore, 3) with the sprayed coating formed by high velocity flame spraying using the above spray powder, an extremely high toughness and impact resistance, a Vickers hardness as high as at least 1,100, and excellent wet wear resistance, can be assured.

The entire disclosure of Japanese Patent Application No. 2000-038969 filed on Feb. 17, 2000 including specification, claims, drawings and summary are incorporated herein by reference in its entirety.

What is claimed is:

1. A spray powder which has a particle size of from 6 to 63 μm and which comprises from 75 to 95 wt % of a ceramic phase made of a WC powder and at least one chromium carbide powder selected from the group consisting of $Cr_3C_2$, $Cr_7C_3$ and $Cr_{23}C_6$, and from 5 to 25 wt % of a metal phase made of a Ni or Ni-based alloy powder, wherein the mean particle size of primary particles of the WC powder constituting the ceramic phase is from 5 to 20 μm, and the mean particle size of primary particles of the chromium carbide powder is from 1 to 10 μm.

2. The spray powder according to claim 1, wherein the mean particle size of the Ni or Ni-based alloy powder is from 1 to 15 μm.

3. The spray powder according to claim 1, wherein the mean particle size of the WC powder is from 10 to 15 μm, the mean particle size of the chromium carbide powder is from 3 to 6 μm, and the mean particle size of the Ni or Ni-based alloy powder is from 1 to 10 μm.

4. The spray powder according to claim 1, which comprises from 60 to 80 wt % of the WC powder, from 10 to 20 wt % of the chromium carbide powder and from 5 to 25 wt % of the Ni or Ni-based alloy having a mean particle size of from 1 to 15 μm.

5. A thermal spraying process which comprises carrying out high velocity flame spraying using the spray powder as defined in claim 1.

6. A sprayed coating which is formed by carrying out high velocity flame spraying using the spray powder as defined in claim 1 and which comprises from 75 to 95 wt % of a ceramic phase made of the WC powder and the chromium carbide powder, and from 5 to 25 wt % of a metal phase made of the Ni or Ni-based alloy powder, wherein the mean particle size of primary particles of the WC powder constituting the ceramic phase is from 5 to 20 μm, and the mean particle size of primary particles of the chromium carbide powder is from 1 to 10 μm.

* * * * *